US009526965B2

(12) United States Patent
Gatherer

(10) Patent No.: US 9,526,965 B2
(45) Date of Patent: Dec. 27, 2016

(54) EXERCISE HARNESSES

(75) Inventor: Donald Gatherer, Aylesbury (GB)

(73) Assignee: Donald William Gatherer, Buckinghamshire (GB)

( * ) Notice: Subject to any disclaimer, the term of this patent is extended or adjusted under 35 U.S.C. 154(b) by 144 days.

(21) Appl. No.: 13/265,500

(22) PCT Filed: Apr. 20, 2010

(86) PCT No.: PCT/EP2010/055209

§ 371 (c)(1),
(2), (4) Date: Mar. 1, 2012

(87) PCT Pub. No.: WO2010/122027

PCT Pub. Date: Oct. 28, 2010

(65) Prior Publication Data

US 2012/0165169 A1 Jun. 28, 2012

(30) Foreign Application Priority Data

Apr. 20, 2009 (GB) ..... 0906732.3

(51) Int. Cl.
*A63B 71/00* (2006.01)
*A63B 21/062* (2006.01)
(Continued)

(52) U.S. Cl.
CPC ..... *A63B 71/0054* (2013.01); *A61H 1/0218* (2013.01); *A63B 21/4001* (2015.10);
(Continued)

(58) Field of Classification Search
CPC ..... A63B 21/1407; A63B 21/1423; A63B 21/1403; A63B 71/0054; A63B 21/1411; A63B 2071/0633; A63B 2071/0627; A63B 2209/10; A63B 2071/0072;A63B 21/4001; A63B 21/4003; A63B 23/025; A63B 2071/0081; A63B 21/065; A61H 1/02; A61H 1/0296; A61H 2201/1604; A61H 2201/1607; A61H 2201/1609; A61H 2201/1611; A61H 2205/02; A61H 2205/04; A61H 1/0218; A61H 1/0229; A61M 16/0683
(Continued)

(56) References Cited

U.S. PATENT DOCUMENTS 559,270 A * 4/1896 Edwards ..... 482/10
761,504 A * 5/1904 Kleinbach ..... 482/96
(Continued)

FOREIGN PATENT DOCUMENTS

GB 2314782 1/1998
WO WO2006/061834 6/2006

*Primary Examiner* — Joshua Lee
(74) *Attorney, Agent, or Firm* — Thorpe North & Western

(57) ABSTRACT

An exercise harness has a band (1) that is retained partially encircling the user's head, by a chin-strap (3) and interconnected head-straps (4). The straps (3, 4) are attached to individual spaced locations of the band (1) by press-studs (6, 7) or two-part fabric fastenings. A cord (13) extending through a pulley-block (14) is clipped at its ends (12) to rings (11) at respective ends of the band (1). Load from a weight or from reaction to head movement is applied to the pulley-block (14) via a swivel connection (15) for equalisation and balancing out of asymmetrical tensioning of the two ends of the band (1) for extension exercise of muscles of the spinal cervix. Unsafe or inappropriate loading causes break-out of one or more of the press-studs (6, 7) or other fastenings to give audible warning of it and a measure of relief.

8 Claims, 6 Drawing Sheets

(51) Int. Cl.

| | |
|---|---|
| ***A63B 21/065*** | (2006.01) |
| *A63B 21/00* | (2006.01) |
| *A63B 23/025* | (2006.01) |
| *A61H 1/02* | (2006.01) |
| *A63B 71/06* | (2006.01) |

(52) U.S. Cl.
CPC ..... *A63B 21/4003* (2015.10); *A63B 21/4005* (2015.10); *A63B 21/4011* (2015.10); *A61H 1/02* (2013.01); *A61H 1/0229* (2013.01); *A61H 1/0292* (2013.01); *A61H 2201/1604* (2013.01); *A61H 2201/1607* (2013.01); *A61H 2205/02* (2013.01); *A63B 21/065* (2013.01); *A63B 21/15* (2013.01); *A63B 21/151* (2013.01); *A63B 21/154* (2013.01); *A63B 23/025* (2013.01); *A63B 2071/0072* (2013.01); *A63B 2071/0081* (2013.01); *A63B 2071/0627* (2013.01); *A63B 2071/0633* (2013.01); *A63B 2209/10* (2013.01)

(58) Field of Classification Search
USPC ..... 482/10–11, 91–148, 904, 906, 907; 602/32–40
See application file for complete search history.

(56) References Cited

U.S. PATENT DOCUMENTS

| | | | | | |
|---|---|---|---|---|---|
| 1,336,910 | A | * | 4/1920 | MacFadden | A61H 1/0218 482/131 |
| 1,517,147 | A | * | 11/1924 | Burnett | 482/10 |
| 1,530,748 | A | * | 3/1925 | Alastalo | A63B 21/0608 482/10 |
| 1,543,346 | A | * | 6/1925 | Titus | 482/10 |
| RE20,211 | E | * | 12/1936 | Motsinger | 128/207.11 |
| 2,314,782 | A | | 3/1941 | Summers | |
| 2,359,387 | A | * | 10/1944 | Riddell | A42B 3/14 2/181 |
| 2,571,461 | A | * | 10/1951 | Livingston et al. | 606/202 |
| 2,609,823 | A | * | 9/1952 | Neff | A45D 8/40 132/273 |
| 2,701,564 | A | * | 2/1955 | Wilhelm | 602/32 |
| 2,740,399 | A | * | 4/1956 | Judovich | 602/36 |
| 3,033,198 | A | * | 5/1962 | Jensen | 602/33 |
| 3,041,621 | A | * | 7/1962 | Brockway | A42B 3/14 2/419 |
| 3,108,587 | A | * | 10/1963 | Das | A61H 1/0218 602/36 |
| 3,118,443 | A | * | 1/1964 | Dykinga | A61H 1/0218 128/DIG. 15 |
| 3,156,239 | A | * | 11/1964 | Uribe | A61H 1/0218 482/10 |
| 3,388,405 | A | * | 6/1968 | Simpson | A42B 3/14 2/418 |
| 3,540,439 | A | * | 11/1970 | Gaylord, Jr. | A61H 1/0218 602/36 |
| 3,871,366 | A | * | 3/1975 | Cotrel | 602/33 |
| 4,327,909 | A | | 5/1982 | Neufeld | |
| 4,373,523 | A | * | 2/1983 | Treutelaar | A61B 17/12 128/207.18 |
| 4,456,249 | A | | 6/1984 | Calabrese | |
| 4,598,908 | A | | 7/1986 | Morgan | |
| 4,645,198 | A | * | 2/1987 | Levenston | A63B 23/025 482/10 |
| 4,674,485 | A | * | 6/1987 | Swanson | A61H 1/0218 602/33 |
| 4,988,093 | A | * | 1/1991 | Forrest, Sr. | A63B 21/0602 2/413 |
| 5,009,420 | A | | 4/1991 | Martelli | |
| 5,010,880 | A | * | 4/1991 | Lamb | A61H 1/0222 602/36 |
| 5,010,898 | A | * | 4/1991 | de Kanawati | A61F 5/3707 128/845 |
| 5,242,347 | A | * | 9/1993 | Keeton | 482/102 |
| 5,248,293 | A | * | 9/1993 | Hubbard et al. | 602/17 |
| 5,451,202 | A | * | 9/1995 | Miller | A61H 1/0218 602/35 |
| 5,505,677 | A | * | 4/1996 | Hinds | 482/10 |
| 5,558,609 | A | | 9/1996 | Olschansky et al. | |
| 6,036,625 | A | * | 3/2000 | Woodruff | 482/121 |
| 6,258,050 | B1 | | 7/2001 | Henderson | |
| 6,390,957 | B1 | * | 5/2002 | Knight | 482/79 |
| 6,966,321 | B2 | * | 11/2005 | Hess | A61F 5/3707 128/846 |
| 7,080,648 | B2 | * | 7/2006 | Frank | 128/846 |
| 7,468,019 | B2 | * | 12/2008 | Zylstra | 482/10 |
| 7,775,938 | B1 | * | 8/2010 | Anderson | A61F 5/05891 482/10 |
| 7,862,526 | B1 | * | 1/2011 | Skowron et al. | 602/18 |
| 8,657,774 | B1 | * | 2/2014 | Fisher | 602/32 |
| 2003/0228955 | A1 | * | 12/2003 | Makofsky | 482/10 |
| 2004/0058780 | A1 | | 3/2004 | Edgeton | |
| 2007/0161473 | A1 | | 7/2007 | McBride | |

* cited by examiner

FIG 2
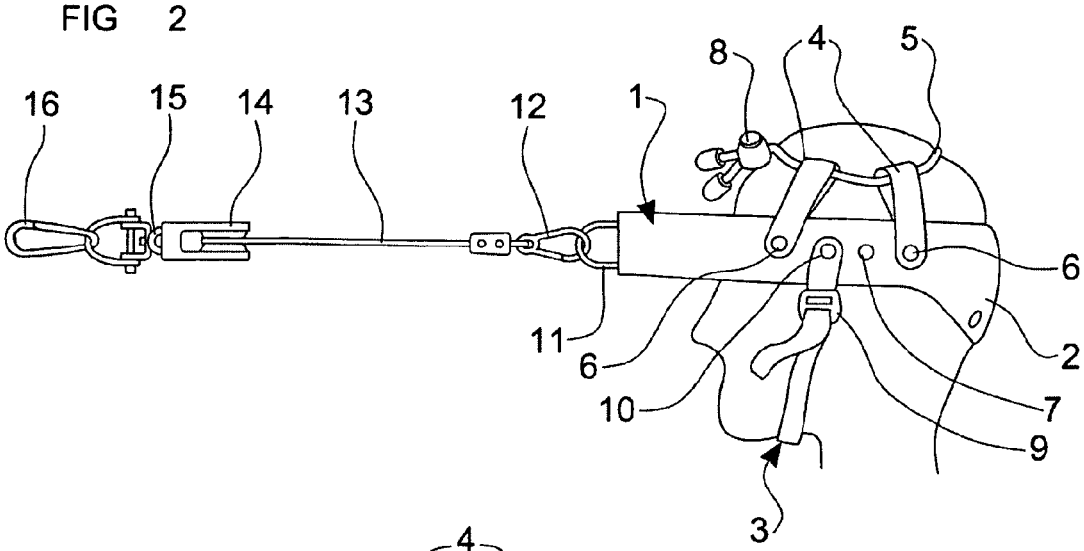
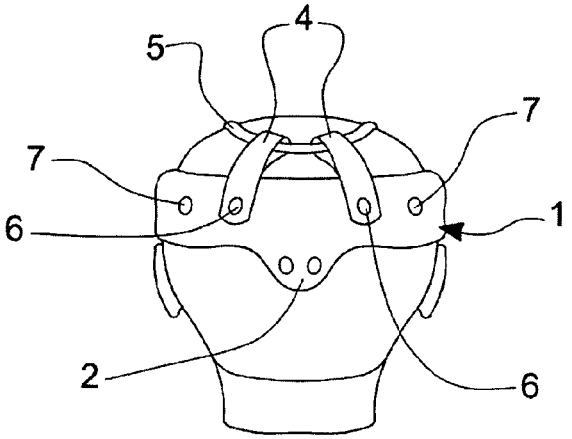
FIG 3
FIG 4
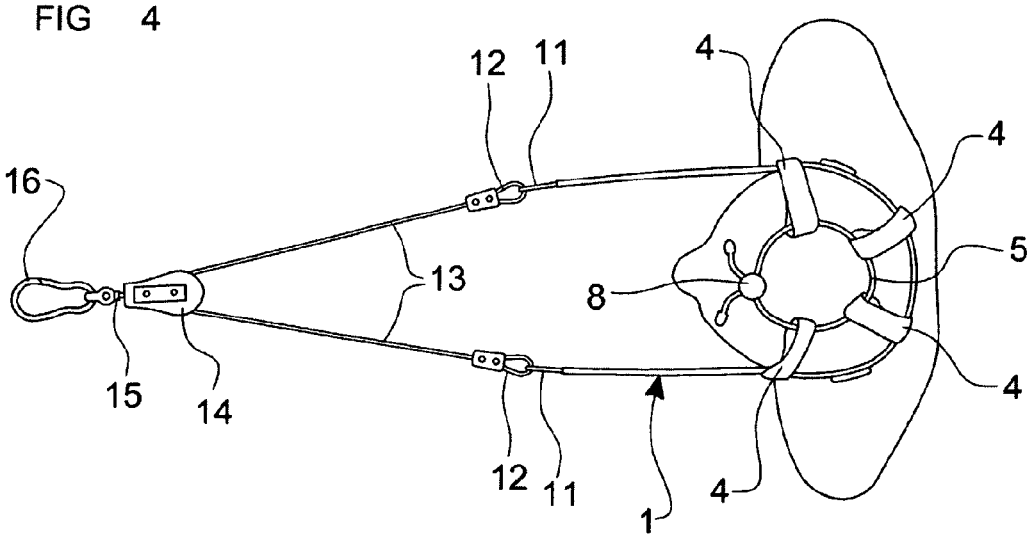

FIG 5
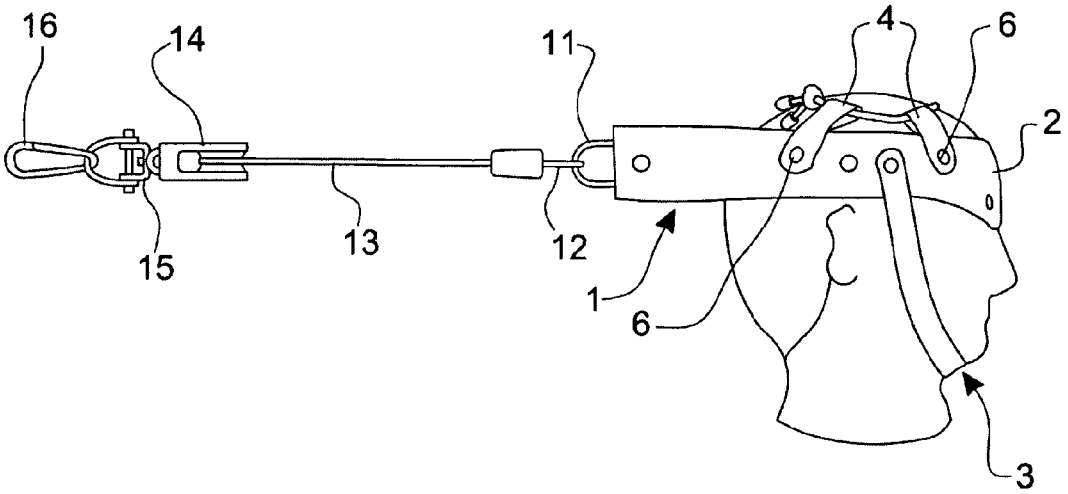
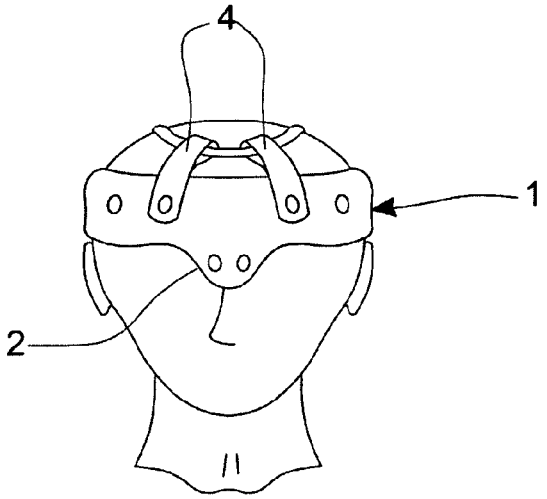
FIG 6
FIG 7
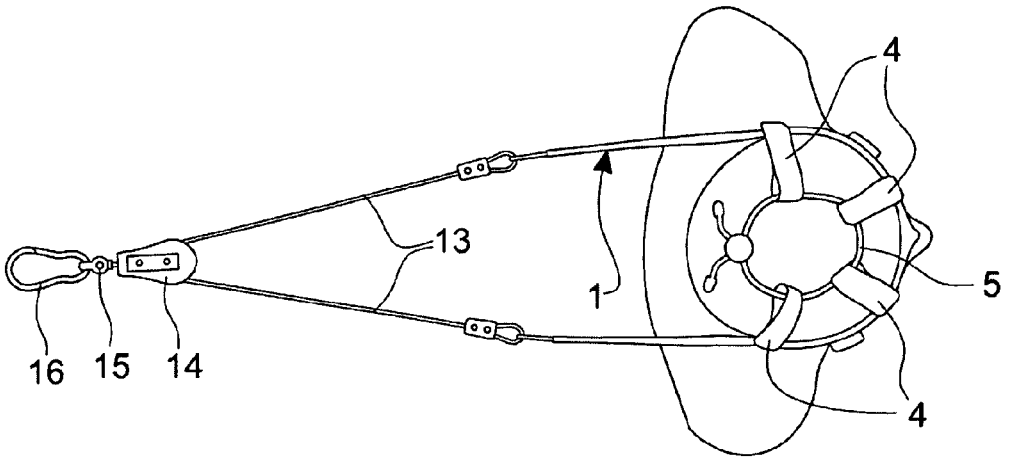

FIG 13
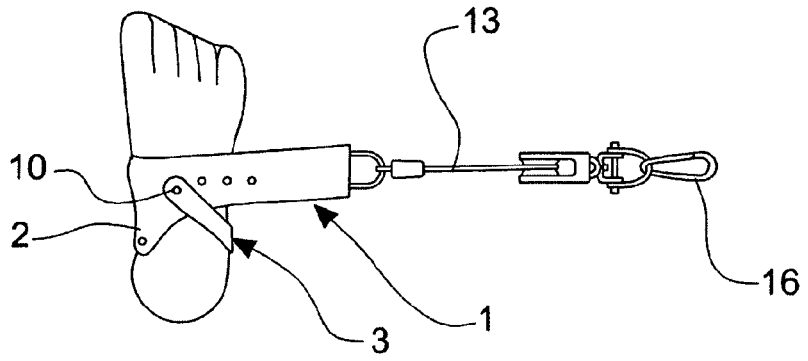
FIG 14
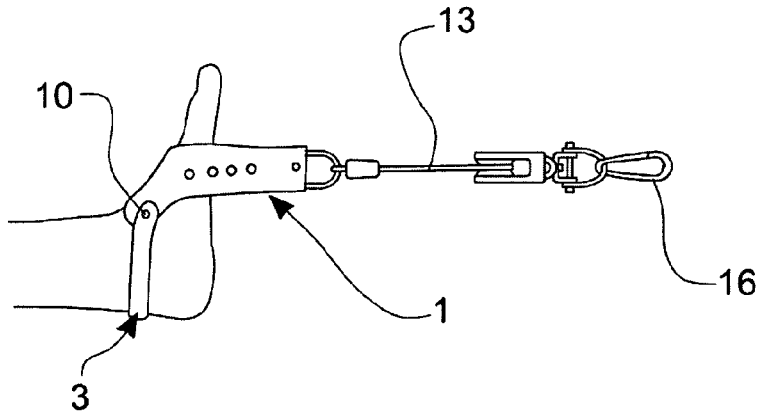
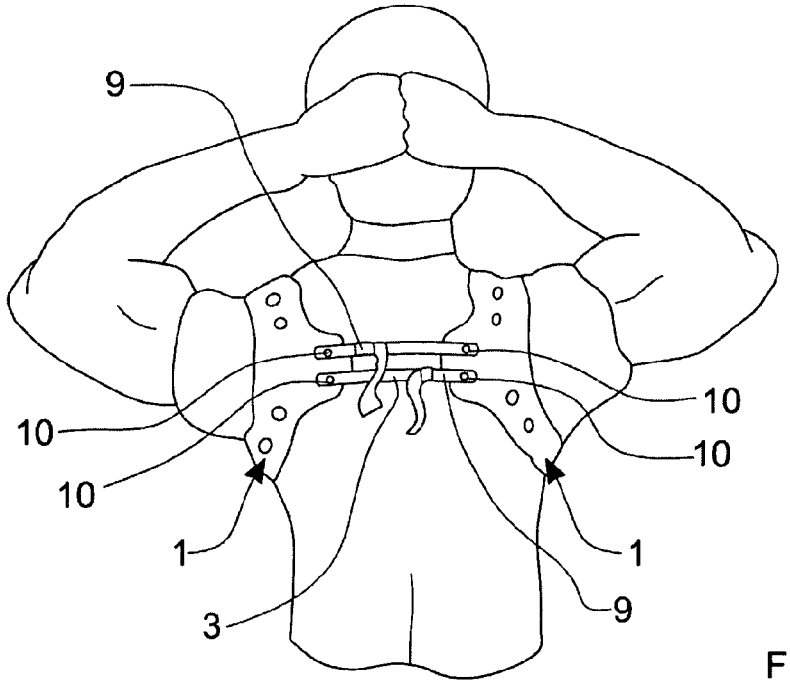
FIG 15

EXERCISE HARNESSES

According to the present invention there is provided an exercise harness that comprises a band for partial encirclement of part of a user's body in the loading of muscles associated with that body-part, wherein the two ends of the band are attached to means for equalising tensioning forces applied to the two ends of the band in loading the muscles.

The use of a band only partially encircling the user's body-part with means for equalising the tensioning forces applied to its two ends has especial advantage. In particular it enables a significantly reduced possibility of injury to the user than otherwise experienced, during rotational repositioning (dynamically or otherwise) of the user's body-part prior to and during loading of the muscles..

The means for equalising the tensioning forces applied to the two ends of the band may take the form of a pulley system in which a cord or other line that is attached to the two ends of the band passes through a pulley of the system so that tensions in the line either side of the pulley, and thereby the tensioning of the two ends of the band, are equalised. The pulley system may include a swivel connection for applying the tensioning to the two ends of the band without twist on their orientation.

The band for partial encirclement of part of the user's body may be a leather strap.

Retention of the band in place on the body-part may be by means which is attached via respective two-part fastenings to individual locations of the band that are spaced lengthwise of the band from one another. In this case each of the two-part fastenings may comprise two mutually-engaging parts that disengage from one another to break the attachment it provides between the retention means and the band, under load on the harness in excess of a threshold value applied for transfer through the fastening. The two-part fastenings may be press-stud fastenings or may be two-part fabric fastenings of the kind (for example sold under the Registered Trade Mark VELCRO) in which one of its parts has upstanding hook-ended threads for engaging with loop-ended or other threads of the other part.

The means for retention of the band may comprise a strap having a two-part fastening at either end for attachment to respective locations of the band, and/or may be a plurality of interconnected straps each of which is attached at one end by a respective two-part fastening to an individual location of the band.

An exercise harness in accordance with the present invention will now be described by way of example, with reference to the accompanying drawings, in which:

FIGS. 2 to 4 are, respectively, a side-elevation, rear view and plan view of the assembled exercise harness of the invention when worn on the head of a user for cervical extension;

FIGS. 5 to 7 are, respectively, a side-elevation, rear view and plan view of the assembled exercise harness of the invention when worn on the head of a user for cervical flexion;

FIG. 13 is illustrative of application of the exercise harness of the invention for adduction of muscles of the foot, leg or hip;

FIG. 14 is illustrative of application of the exercise harness of the invention for dorsiflexion of the foot;

FIG. 15 is illustrative from the rear of application of two exercise harnesses of the invention for extension of muscles of the user's back.

Figure 1:
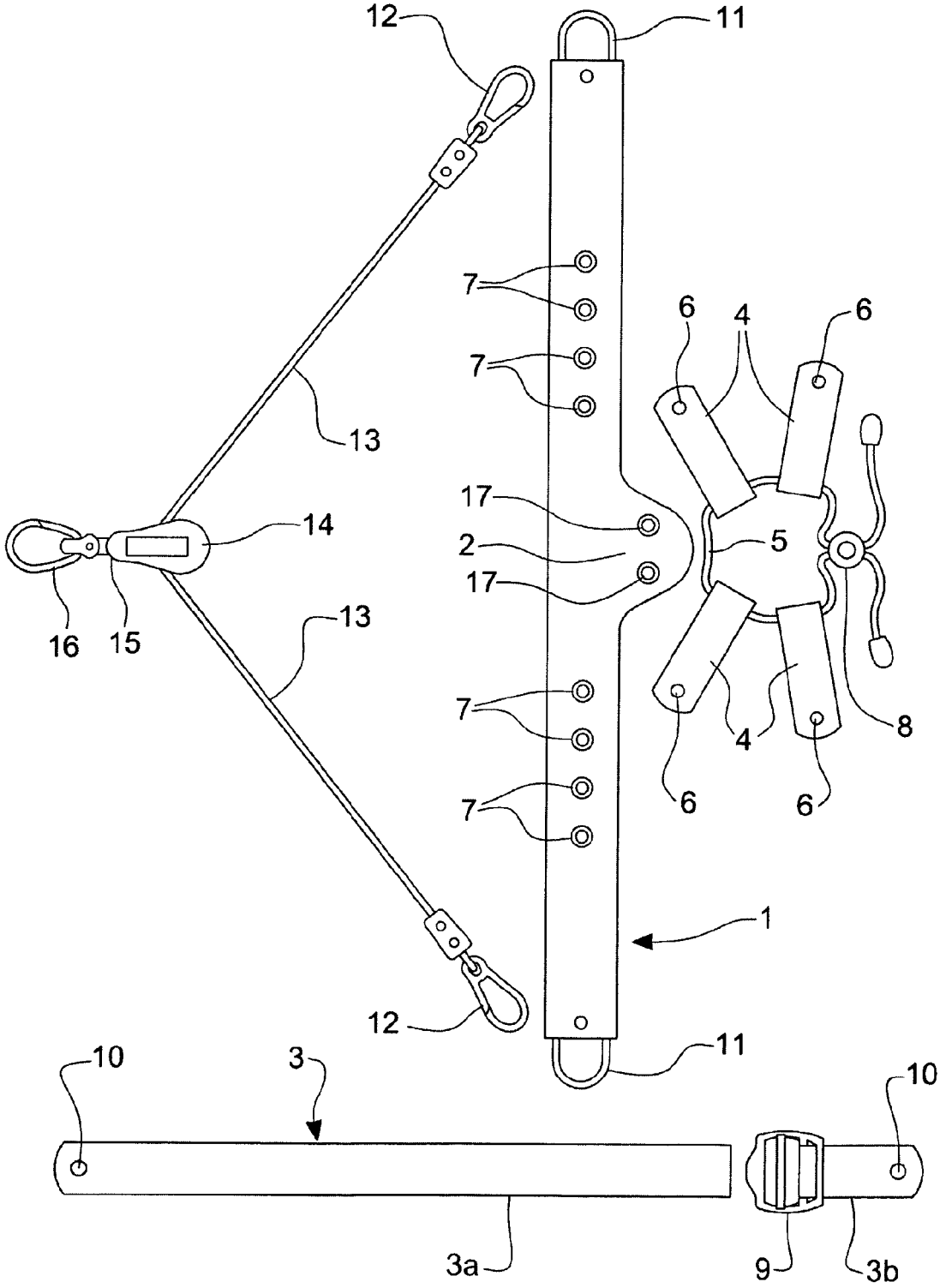
FIG. 1 is a plan view showing the individual component parts of the exercise harness of the invention prior to its assembly for use.

The components of the exercise harness of the invention as illustrated in FIG. 1 will be described in the context of the use of the harness as illustrated by FIGS. 2 to 4, for cervical extension.

Referring to FIGS. 1 to 4, the harness of the invention involves a main band in the form of a leather strap 1 that is worn in this example to embrace the user's head at eye level. The strap 1, which is padded on the inside for comfort to the user, has a central, smoothly-profiled portion 2 of increased width for availability as an attachment location and for fitting snugly to the contour of the user's head. Retention of the strap 1 located in place on the head, is achieved by means of a leather chin-strap 3 and four leather head-straps 4 which are looped onto a cord 5 that is retained in a loop on the crown of the head of the user. The straps 4 fasten to the strap 1 at individual locations spaced from one another lengthwise of the strap 1. The fastening to the strap 1 in each case is by a two-part press-stud fastener that involves a press-cap 6 attached to the respective head-strap 4. The fastening is effected by engagement of the cap 6 with one or another of a series of eight studs 7 that are secured to the strap 1 spaced from one another lengthwise of it.

Both ends of the cord 5 pass through a cord-lock 8 that enables the size of the crown-loop to be adjusted for secure fit and proper and comfortable positioning of the straps 1 and 4 on the user's head. Once adjustment has been made, the chin-strap 3 is tightened to secure the harness. In this respect the chin-strap 3, which is in two parts 3*a* and 3*b* that couple together via a ladder-lock buckle 9 of the part 3*b*, is fastened at either end to the strap 1. The fastening to the strap 1 at either end of the strap 3 is by a two-part press-stud fastener that involves a press-cap 10 which is attached to the respective strap-part 3*a* or 3*b*, and which engages with one of the studs 7 on the strap 1. Tightening of the chin-strap 3 is achieved by pulling the strap 3*a* tighter through the buckle 9.

An individual D-ring 11 is riveted to each end of the strap 1 for engagement by respective caribines 12 that are secured to opposite ends of a strong cord 13. The cord 13 extends through a pulley of a pulley-block 14 which is attached via a swivel connection 15 to a carabine 16 that is used in the application of load to the harness. In this regard, the carabine 16 may be used to secure the harness to a fixed anchor point (not shown) so that the loading results from reaction to force applied to the harness by the user, but it may be used to secure the harness to an external source of load such as that imposed, for example, by a freely-hanging weight acting via a pulley or otherwise, or by a comparable system to this, or by manual application of force by a therapist or other person, or via a dynamometer system.

The application of load to the harness in this example is for load testing of the muscles of the cervical spine, or exercise or therapy to those muscles. This may be for medical rehabilitation in for example cases of whiplash injury (hyperextension-hyperflexion injury), or for muscle-strengthening or muscle-conditioning in a sports or occupational context, or generally.

In application of the load to the harness it is necessary to ensure that there is equal tensioning of the two ends of the strap 1. Differences in tensioning may result in muscle injury. In particular in the context of use for cervical extension illustrated in FIGS. 2 to 4, it may result in axial loading of the spine.

Although the system using the cord 13 round the pulley of the pulley-block 14 and the swivel connection 15 to it, acts to balance out asymmetrical loading, a safety feature of the harness of the present invention is that the occurrence of inappropriate and unsafe loading, whether static or dynamic, gives rise to an immediately-recognisable break-out within the harness attachment. More especially in this respect, load in excess of a threshold value results in transfer of force that breaks the engagement between the press-cap 6 and stud 7 in the two-part press-stud fastening to the strap 1 of each of one or more of the head-straps 4. The same breaking of engagement between the press-cap 6 and stud 7 may also or alternatively take place between one or both of the press-caps 10 of the chin-strap 3 and its stud 7. In each case the breaking of engagement is accompanied by a popping noise and at least partial release of the strap 1 from its retention on the user's head. This gives warning of the dangerous condition and a measure of relief from it.

Although the exercise harness has been described above with reference to FIGS. 2 to 4 for cervical extension it is applicable as illustrated in FIGS. 5 to 7 for cervical flexion. The strap 1 in this case is retained by the straps 3 and 4 with the portion 2 at the front of the user's head and with the system of cord 13 and pulley 14 extending behind him/her. The action of the harness in this configuration is essentially the same in the event of the occurrence of inappropriate and unsafe loading, as when used for cervical extension, to give warning and a measure of relief from the dangerous condition. The engagement between the press-cap 6 and its stud 7 in the two-part press-stud fastening to the strap 1 of each of one or more of the head-straps 4 is broken, and/or there is a break of the engagement between one or both of the press-caps 10 of the chin-strap 3 and their respective studs 7. As well as giving a measure of relief from the condition, there is also therefore audible and visual indication of its existence.

Figure 8:
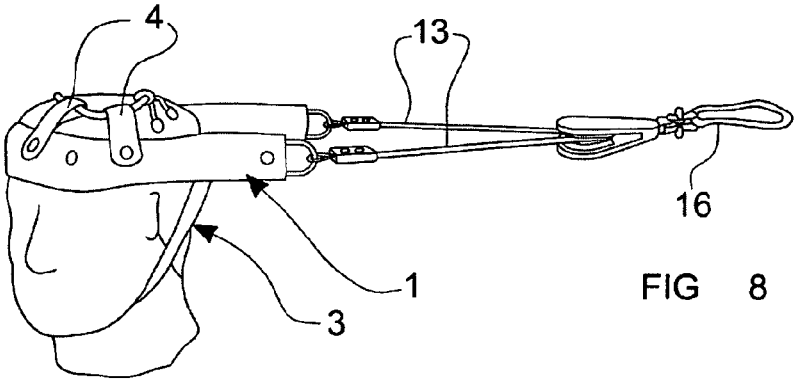
FIG. 8 is illustrative of the assembled exercise harness of the invention when used for cervical side flexion.
Figure 9:
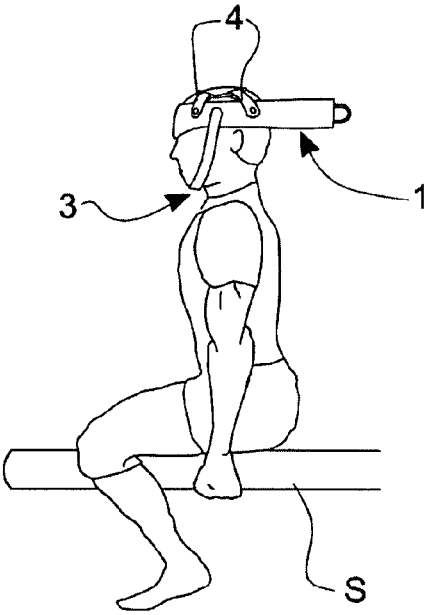
FIGS. 9 to 12 are illustrative of further uses of the assembled exercise harness of the invention for cervical exercise and therapy.
Figure 10:
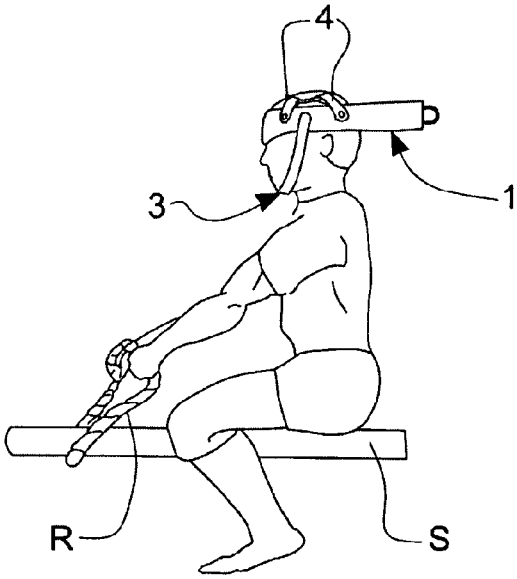
Figure 11:
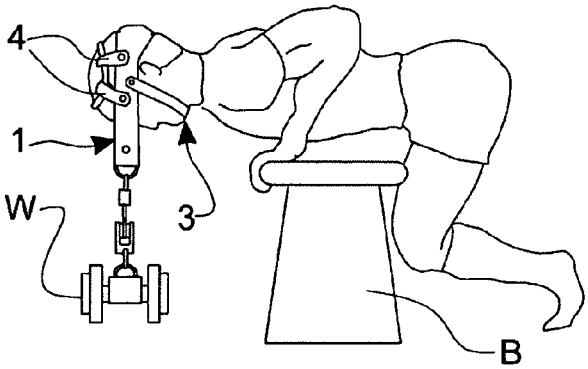
Figure 12:
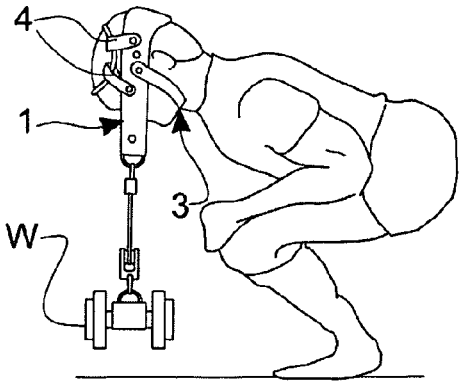

Other examples of use of the harness for cervical exercise and therapy are illustrated in FIGS. 8 to 12. Of these, FIG. 8 illustrates use for cervical side flexion, in which the head is subjected to sideways loading from the strap 1, and FIGS. 9 and 10 illustrate respectively, use for cervical flexion while seated astride a seat S, and cervical flexion while seated with pulling of a rope R looped round the seat S. FIGS. 11 and 12 illustrate cervical exercise using a free-hanging weight W, FIG. 11 illustrating this for pressing prone over a bench B, whereas FIG. 12 illustrates lifting of the dead weight W.

The harness may also be used for exercising and therapy of other muscles. In this regard, FIG. 13 illustrates use for adduction of the foot, leg or hip, in which the strap 1 partly encircles the user's foot and is retained in place by the strap 3 with its two press-caps 10 engaged with respective studs 7; the straps 4 and cord 5 are not used in this application. The occurrence of inappropriate and unsafe loading, causes one or both of the press-caps 10 to disengage from their respective studs 7 to give warning and a measure of relief from the condition.

Use of the harness for dorsiflexion of the foot is illustrated by FIG. 14. As with adduction, the straps 4 and cord 15 are not used, the harness being retained in place by means of the strap 3 which in this case extends round the ankle with the press-caps 10 engaged with studs 17 on the portion 2 of the strap 1 (see FIG. 1).

Two forms of the exercise harness of FIG. 1 without the straps 4 and cord 5, are used for extension of the user's back muscles, as illustrated in FIG. 15. The straps 1 of the two harnesses partially encircle the user's shoulders and are interlinked by the two straps 3 tightened across the user's back using the buckles 9. The two press-caps 10 of each strap 3 are engaged with respective studs 17 of the two harnesses so that any inappropriate and unsafe loading results in the interlinking provided by one or both of the straps 3 being broken.

Figure 16:
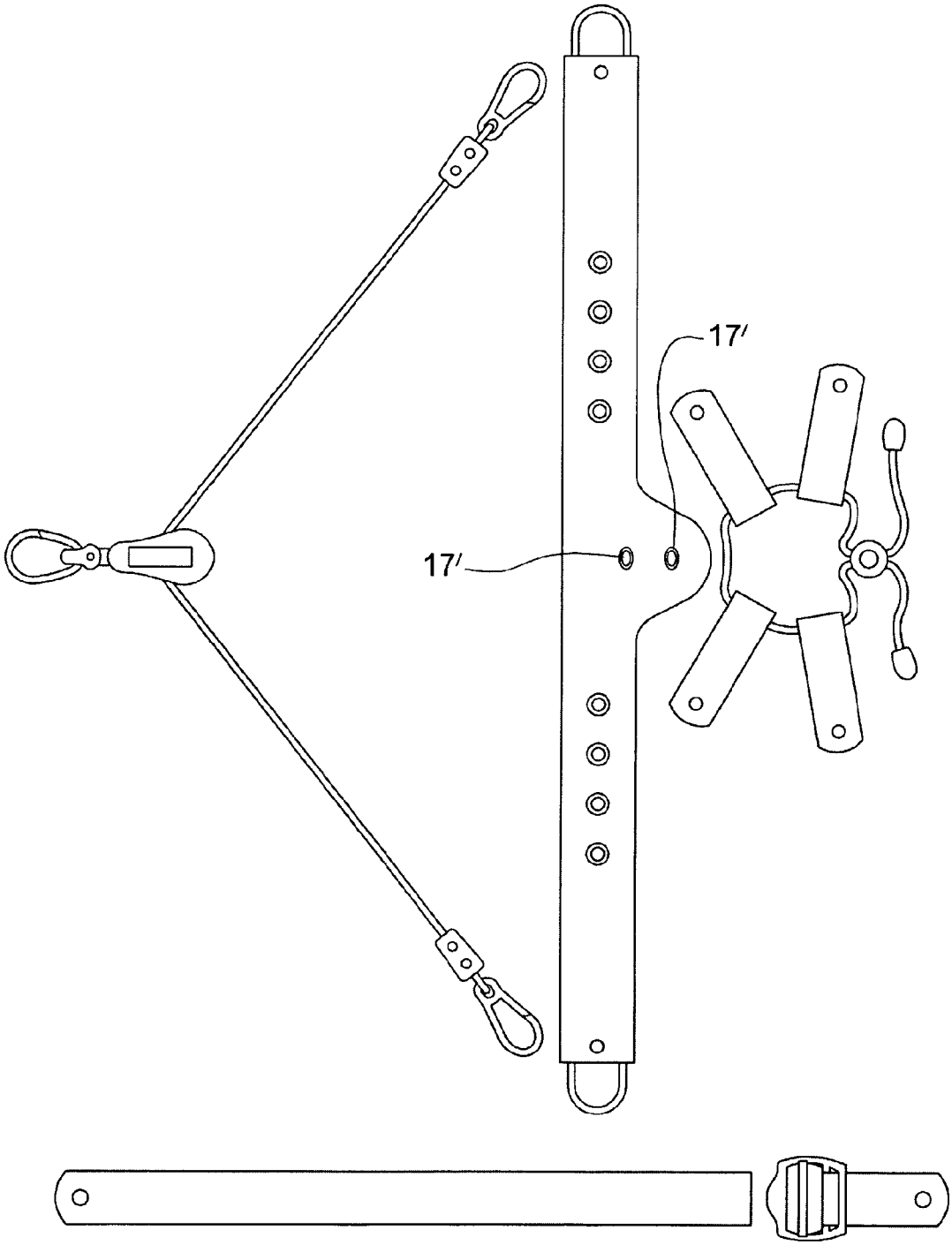
FIG. 16 is a plan view corresponding to FIG. 1 of component parts of the exercise harness of the invention including a modified form of the main strap of the harness.

There may be advantage in modifying the main strap 1 to alter the relative disposition with respect to one another of the studs 17 within the portion 2. A modification in this regard is illustrated by FIG. 16 where the studs 17 are replaced by studs 17' having a one-above-the-other, rather than a side-by-side, disposition.

Although the two-part fastenings used in the harnesses of FIGS. 1 to 16 are of the press-stud form, other forms may be used. For example the fastenings used may be two-part fabric fastenings of the kind marketed under the Registered Trade Mark VELCRO, in which one part of the fastening involves upstanding hook-ended threads, and the other part loop-ended or other upstanding threads for engagement by the hook-ended threads. Breaking of the engagement is normally accompanied by a tearing sound that gives good audible warning of the undesirable condition.

The invention claimed is:

1. An exercise harness comprising:

a load bearing band for partial encirclement of a user's head in a loading of muscles associated therewith, wherein said band incorporates two ends and an upper side and a lower side extending lengthwise between said ends;

a cord incorporates two opposite ends;

said ends of said band being attached to said ends of said cord;

said two ends of said band being separated, in use, by an opening;

said exercise harness incorporating a pulley system;

said cord being secured in said pulley system;

a connection extending from said pulley system on which a load is applied in use;

said pulley system being provided to equalise tensioning forces applied via said cord to said two ends of said band in loading said muscles;

wherein said exercise harness further comprises a chin strap and a plurality of head straps which are in addition to said load bearing band and are sized and shaped to extend over a chin and over the head of the user respectively; said chin strap extending below said lower side and said head straps extending above said upper side of said band; said chin strap and said head straps being disposed in opposite directions; said plurality of head straps each comprising a first end detachably attached to said load bearing band and a second end looped to receive a cord loop; and each of said straps being individually fastened to said band at locations spaced from one another lengthwise thereof by a reattachable two-part press-fastening, said press-fastening comprising two mutually-engaging parts secured to a respective one of said straps and said band which disengage from one another to result in a break-out within an attachment between said strap and said band if inappropriate and unsafe loading exceeding a threshold value is applied to any one or more of said straps and which are reattachable after said break-out.

2. An exercise harness according to claim 1, further comprising a swivel connection located between said pulley system and said connection on which said load is applied.

3. An exercise harness according to claim 1, wherein said two-part fastening is a press-stud fastening.

4. An exercise harness according to claim 1, wherein said two-part fastening is a two-part fabric fastening where one of its parts has upstanding hook-ended threads for engaging with threads of another part.

5. An exercise harness according to claim 1, wherein said band is sized and shaped to wrap around at least part of a user's head and the head straps extend from said band over a crown of the head.

6. An exercise harness according to claim 1, wherein said mutually-engaging parts emit a popping sound when they disengage.

7. A method of therapy comprising the step of using the harness of claim 1.

8. A method of therapy according to claim 7, wherein the harness is employed for modes of use selected from the group consisting of: cervical extension, cervical flexion, cervical side flexion, adduction of muscles of a foot, adduction of muscles of a leg, adduction of muscles of a hip, and extension of muscles of a user's back.

* * * * *